US009021994B2

(12) United States Patent
Woo et al.

(10) Patent No.: US 9,021,994 B2
(45) Date of Patent: May 5, 2015

(54) VARIABLE COMPRESSION RATIO APPARATUS

(71) Applicant: Hyundai Motor Company, Seoul (KR)

(72) Inventors: Yoonsik Woo, Yongin-si (KR); Jin Kook Kong, Suwon-si (KR); Dong Seok Lee, Suwon-si (KR); Eun Ho Lee, Yongin-si (KR); Soo Hyung Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 16 days.

(21) Appl. No.: 13/712,641

(22) Filed: Dec. 12, 2012

(65) Prior Publication Data

US 2014/0096747 A1 Apr. 10, 2014

(30) Foreign Application Priority Data

Oct. 5, 2012 (KR) ..... 10-2012-0110946

(51) Int. Cl.
*F02B 75/04* (2006.01)
*F01M 11/02* (2006.01)

(52) U.S. Cl.
CPC ..... *F02B 75/045* (2013.01); *F01M 11/02* (2013.01)

(58) Field of Classification Search
CPC ..... F02B 75/044; F02D 15/02
USPC ..... 123/48 B, 197.2, 197.3, 197.4, 78 E, 123/78 BA, 48 R, 48 A, 48 AA
See application file for complete search history.

(56) References Cited

U.S. PATENT DOCUMENTS

| | | | | |
|---|---|---|---|---|
| 2003/0075125 | A1* | 4/2003 | Kreuter | 123/78 BA |
| 2012/0042854 | A1* | 2/2012 | Lee et al. | 123/48 B |
| 2012/0118270 | A1* | 5/2012 | Lee | 123/48 B |
| 2012/0125297 | A1* | 5/2012 | Lee et al. | 123/48 B |

FOREIGN PATENT DOCUMENTS

KR 1020120053888 A 5/2012

* cited by examiner

*Primary Examiner* — Marguerite McMahon
*Assistant Examiner* — Tea Holbrook
(74) *Attorney, Agent, or Firm* — Morgan, Lewis & Bockius LLP

(57) ABSTRACT

A variable compression ratio apparatus includes: a piston defining a combustion chamber, a connecting rod connected to the piston; an eccentric link eccentrically connected to the piston, a swing link connected to the eccentric link so as to rotate the eccentric link, a crankpin to which the connecting rod is connected, and a crank web disposed at both sides of the crankpin and provided with a guide portion for guiding downward motions of the eccentric link and the swing link when the eccentric link and the swing link move downward. Thereby, the downward motions of the eccentric link and the swing link are stabilized.

5 Claims, 4 Drawing Sheets

VARIABLE COMPRESSION RATIO APPARATUS

CROSS-REFERENCE TO RELATED APPLICATION

The present application claims priority of Korean Patent Application Number 10-2012-0110946 filed Oct. 5, 2012, the entire contents of which application is incorporated herein for all purposes by this reference.

BACKGROUND OF INVENTION

1. Field of Invention

The present invention relates to a variable compression ratio apparatus, and more particularly to a variable compression ratio apparatus for providing improved dynamic stability of dual link type eccentric links and dual link type swing links.

2. Description of Related Art

In general, the thermal efficiency of a heat engine is increased as a compression ratio is increased. In a spark-ignition engine, the thermal efficiency thereof is increased by advancing ignition timing up to a predetermined level.

However, in the spark-ignition engine, abnormal combustion may occur when advancing the ignition timing in a state of a high compression ratio, and this may cause damage to the engine. Therefore, there is a limitation in advancing the ignition timing, thereby resulting in the deterioration in output power.

A variable compression ratio (VCR) apparatus is an apparatus which changes a compression ratio of an air-fuel mixture in accordance with an operation state of the engine.

The variable compression ratio apparatus raises the compression ratio of an air-fuel mixture when the engine is driven at a low load in order to improve fuel economy. Further, the variable compression ratio apparatus lowers the compression ratio of an air-fuel mixture when the engine is driven at a high load in order to prevent knocking and to improve output power of the engine.

U.S. Pat. No. 6,581,552 teaches a variable compression ratio apparatus in the related art. In the variable compression ratio apparatus, a connecting rod is connected to a piston defining a combustion chamber, the connecting rod is connected to a crankshaft, and an eccentric ring is coupled to a portion where the connecting rod is connected to the piston.

An eccentric swing member is connected to the eccentric ring, the eccentric swing member is connected to a slide by means of a coupling, and the slide is connected to a driving device so that the slide is moved by the driving device.

In the variable compression ratio apparatus, the slide is moved by operation of the driving device, and the motion of the slide is transferred to the eccentric swing member via the coupling so that the eccentric swing member is rotated. The rotational motion of the eccentric swing member changes a height of a top dead center of the piston via the connecting rod, thereby changing the compression ratio of the combustion chamber defined by the piston.

Such a variable compression ratio apparatus requires a rigid structure, a stable operation and a simplified structure with respect to the eccentric swing member.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a variable compression ratio apparatus having advantages of implementing stable load balancing, thereby improving a dynamic stability of a swing motion, increasing a structural rigidity, and achieving stable downward motions of a piston and links without moving out of the path in downward motion when the links move downward together with the piston.

Various aspects of the present invention provide for a variable compression ratio apparatus including: a piston defining a combustion chamber; a connecting rod connected to the piston; an eccentric link eccentrically connected to the piston; a swing link connected to the eccentric link so as to rotate the eccentric link; a crankpin to which the connecting rod is connected; and a crank web disposed at both sides of the crankpin and provided with a guide portion for guiding downward motions of the eccentric link and the swing link when the eccentric link and the swing link move downward.

The guide portion may be formed to be expanded in a radial direction outwardly from an exterior diameter of the crankpin.

The guide portion may be formed in a circular arc shape.

The guide portion may include an inner surface for guiding a downward motion of the swing link.

The inner surface may be formed as a smooth flat surface excellent in surface roughness.

The crank web may include a balancing portion integrally formed with the guide portion at the opposite side of the guide portion, and an inner surface of the balancing portion may be formed as a smooth flat surface excellent in surface roughness so as to guide downward motions of the eccentric link and the swing link.

The eccentric link and the swing link may be respectively a dual link type.

A control shaft for transferring a rotational driving power may be mounted on the swing link.

The eccentric links and the swing links may be configured as a dual link type, thereby achieving stable load balancing, improving a dynamic stability of a swing motion, and increasing a structural rigidity.

In addition, the downward motion may be guided by the crank web when the swing links and the eccentric links move downward together with the piston, and thereby stable downward motions can be achieved without moving out of the path in downward motion.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
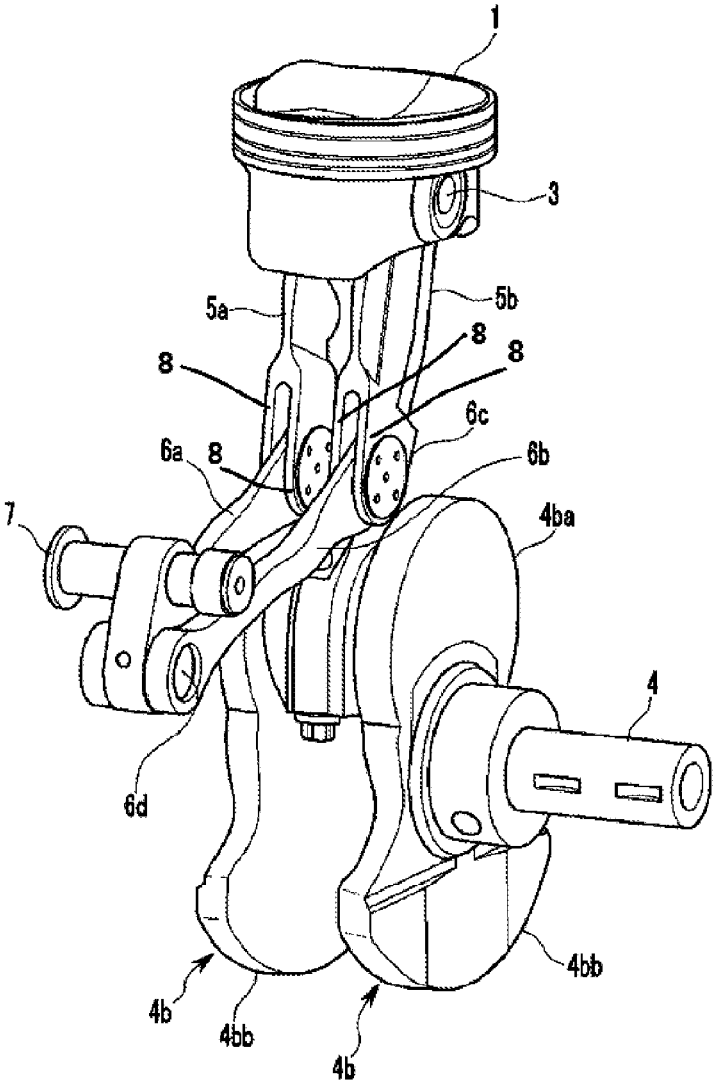
FIG. 1 is a perspective view of an exemplary variable compression ratio apparatus according to the present invention.
Figure 2:
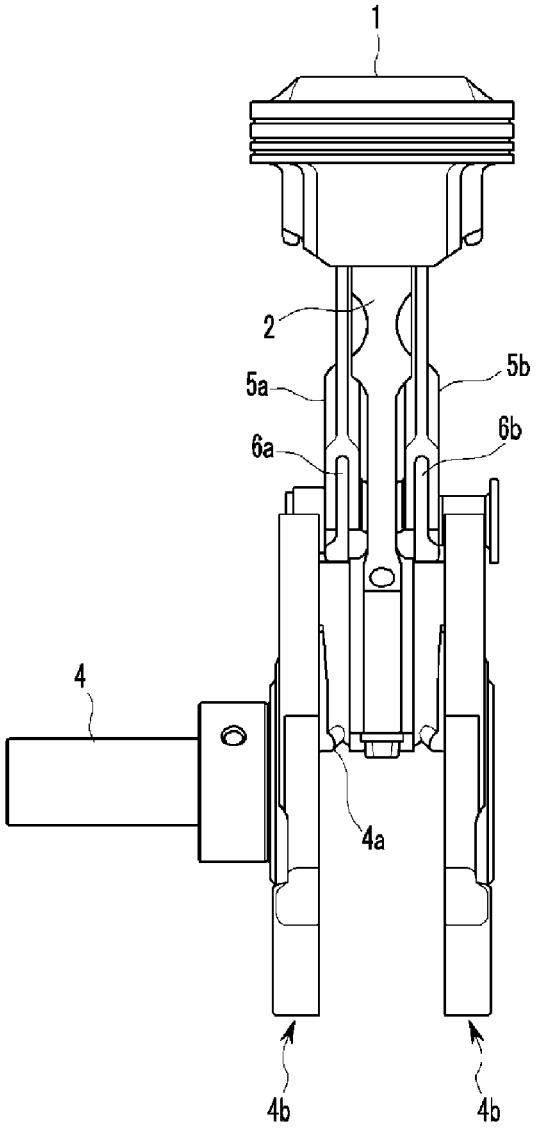
FIG. 2 is a front view of an exemplary variable compression ratio apparatus according to the present invention.

Referring to FIGS. 1 and 2, a piston 1 defining a combustion chamber is formed with an assembly groove recessed inwardly from a lower portion of the piston 1. A connecting rod 2 is inserted into the assembly groove, and the connecting rod 2 is engaged with the piston 1 by means of a piston pin 3.

An assembly hole communicating with the assembly groove is formed in the piston 1 in a diameter direction of the piston 1. The piston pin 3 is fitted into the assembly hole so as to connect the connecting rod 2 and the piston 1 to each other.

A crankshaft 4 is engaged with the connecting rod 2 so that an up-and-down motion of the connecting rod 2 is transformed into a rotational motion of the crankshaft 4.

A pair of eccentric links 5*a* and 5*b*, which are a dual link type, is respectively disposed at both sides of the connecting rod 2. The eccentric links 5*a* and 5*b* are respectively inserted into the assembly groove of the piston 1 so as to be eccentrically connected to the connecting rod 2 by means of the piston pin 3.

Dual link type swing links 6*a* and 6*b* are connected to the eccentric links so as to be engaged with the eccentric links by means of pins 6*c*.

A pin 6*d* is penetratively fitted into the swing links 6*a* and 6*b*, a control shaft 7 is connected to the pin 6*d*, and the control shaft 7 is connected to a driving device, which is not illustrated in the drawing, so that the control shaft 7 transfers a rotational driving power of the driving device to the swing links 6*a* and 6*b*.

The driving device may be configured as an electrically powered device such as a motor, a hydraulic device that operates with hydraulic pressure, etc.

When the driving device operates, the swing links 6*a* and 6*b* perform swing motions though the control shaft 7, the swing motions of the swing links are transferred to the eccentric links 5*a* and 5*b* so that the eccentric links 5*a* and 5*b* perform swing motions, the swing motions of the eccentric links 5*a* and 5*b* change a height of a top dead center of the piston 1, and thereby the compression ratio is changed.

The connecting rod 2 is connected to the crankshaft 4 by means of a crankpin 4*a*. The crankpin 4*a* and the crankshaft 4 are connected to each other with a crank web 4*b* interposed therebetween.

The crank webs 4*b* are disposed at both of left and right sides of the crankpin 4*a*.

The crankshaft 4 is connected to an approximate center portion of the crank web 4*b* in a longitudinal direction of the crank web 4*b*.

On the basis of the center portion, a crankpin connection portion 4*ba* is formed on one side of the crank web 4*b*, and a balancing portion 4*bb* is formed on the opposite side of the crank web 4*b*.

Figure 3:
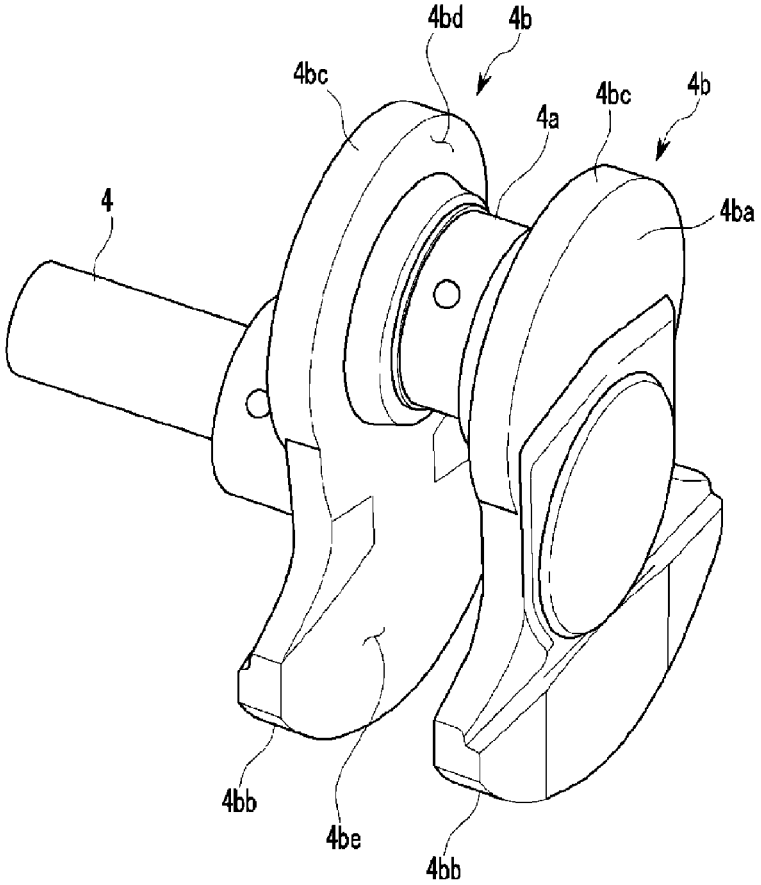
FIG. 3 is a perspective view of an exemplary crank web according to the present invention.

Referring to FIG. 3, the crankpin connection portion 4*ba* has a guide portion 4*bc* formed to be expanded in a radial direction outwardly from an exterior diameter of the crankpin 4*a*.

The guide portion 4*bc* is formed in a circular arc shape.

The guide portions 4*bc* have inner surfaces 4*bd* which are faced to each other and formed as smooth flat surfaces.

The balancing portions 4*bb* have inner surfaces 4*be* which are faced to each other and formed as smooth flat surfaces.

The guide portion 4*bc* and the balancing portion 4*bb* are integrally formed with each other. One will appreciate that the guide and balancing portions may be monolithically formed.

The smooth flat surface refers to a surface excellent in surface roughness without protrusions, depressions or curved portions.

Figure 4:
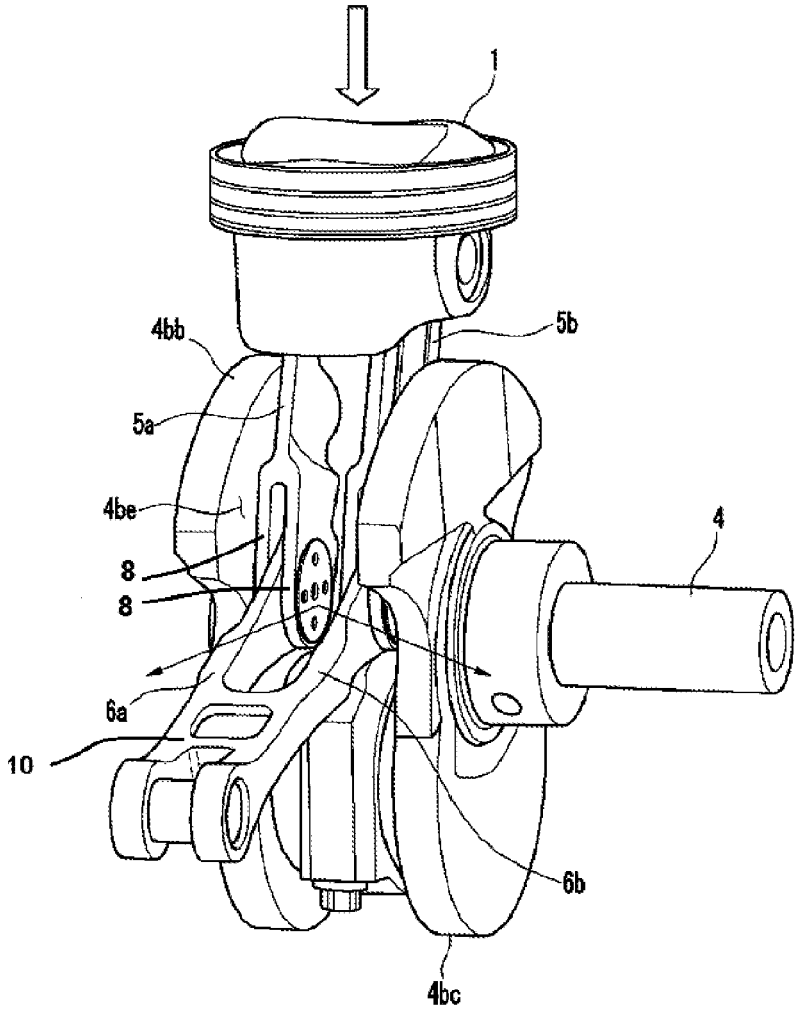
FIG. 4 is a view for explaining an operation of an exemplary variable compression ratio apparatus according to the present invention.

Referring to FIG. 4, the piston 1 is moved downward in the direction of an arrow shown in FIG. 4, in accordance with the pressure after an explosion stroke.

The pressure exerted against the piston 1 is transferred to each of the dual link type eccentric links 5*a* and 5*b* and the dual link type swing links 6*a* and 6*b*, and thereby pushing the eccentric links 5*a* and 5*b* and the swing links 6*a* and 6*b* in left and right directions (directions taken along the crankshaft) shown as arrows in FIG. 4.

The pair of the swing links 6*a* and 6*b* is extendedly formed from one swing link body 10, wherein each of the eccentric links 5*a* and 5*b* has two flanges 8 spaced apart from each other, and wherein each distal end of the swing links 6*a* and 6*b* is inserted into an coupled to the two flanges 8 of corresponding link. When the eccentric links 5*a* and 5*b* and the swing links 6*a* and 6*b* are moved downward together with the piston 1, the eccentric links 5*a* and 5*b* and the swing links 6*a* and 6*b* come into contact with the inner surfaces 4*bd* of the guide portions 4*bc*, which are expanded in the radial direction, and thus the downward motions of the eccentric links 5a and 5*b* and the swing links 6*a* and 6*b* are guided by the inner surfaces 4*bd* of the guide portions 4*bc*. Thereby, the eccentric links 5*a* and 5*b* and the swing links 6*a* and 6*b* are stably moved downward along the path in downward motion without moving away from each other in an axial direction and without moving out of the path of the downward motion.

As the downward motion of the piston 1 is continuously performed, the eccentric links 5*a* and 5*b* and the swing links 6*a* and 6*b* are moved downward along the inner surfaces 4*be* while being guided by the inner surfaces 4*be* in the state in which the eccentric links 5*a* and 5*b* and the swing links 6*a* and 6*b* are in contact with the inner surfaces 4*be* of the balancing portion 4*bb*, and therefore the downward motions of the eccentric links 5*a* and 5*b* and the swing links 6*a* and 6*b* are stably performed along the path of the downward motion.

For convenience in explanation and accurate definition in the appended claims, the terms lower, front, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus, comprising:

a piston defining a combustion chamber;

a connecting rod connected to the piston;

a pair of eccentric links eccentrically connected to the piston;

a pair of swing links connected to the pair of eccentric links so as to rotate the eccentric links;

a crankpin connected to the connecting rod; and a crank web disposed at both sides of the crankpin, said crank web having a guide portion for guiding motion of the pair of eccentric links and the pair of swing links;

wherein the guide portion is formed to expand in a radial direction outwardly from an exterior diameter of the crankpin, wherein the guide portion comprises an inner surface expanded in the radial direction for guiding a downward motion the pair of eccentric links and/or the pair of swing links, wherein the pair of the swing links is extendedly formed from one swing link body, wherein each of the eccentric links has two flanges spaced apart from each other, and wherein each distal end of the swing links is inserted into and coupled to the two flanges of corresponding eccentric link.

2. The variable compression ratio apparatus of claim 1, wherein:

the guide portion is formed in a circular arc shape.

3. The variable compression ratio apparatus of claim 1, wherein:

the inner surface is formed as a smooth flat surface excellent in surface roughness.

4. The variable compression ratio apparatus of claim 1, wherein:

the crank web comprises a balancing portion integrally formed with the guide portion at the opposite side of the guide portion; and an inner surface of the balancing portion is formed as a smooth flat surface but with surface roughness so as to guide downward motions of the eccentric link and the swing link.

5. The variable compression ratio apparatus of claim 1, wherein:

a control shaft for transferring a rotational driving power is mounted on the swing links.

* * * * *